US006056205A

United States Patent [19]

Dupre

[11] Patent Number: 6,056,205

[45] Date of Patent: May 2, 2000

[54] SNOW MAKING TOWER AND METHOD OF MANUFACTURE

[76] Inventor: Herman K. Dupre, c/o Seven Springs, Champion, Pa. 15622

[21] Appl. No.: 09/429,092

[22] Filed: Oct. 29, 1999

Related U.S. Application Data

[62] Division of application No. 09/153,975, Sep. 16, 1998.

[51] Int. Cl.[7] ..... F25C 3/04

[52] U.S. Cl. ..... 239/14.2; 29/890.143

[58] Field of Search ..... 239/600, 14.2, 239/276, 280; 29/890.142, 890.143

[56] References Cited

U.S. PATENT DOCUMENTS

| | | | |
|---|---|---|---|
| 3,494,559 | 2/1970 | Skinner | 139/14.2 |
| 3,706,414 | 12/1972 | Dupre | 239/14.2 |
| 5,908,156 | 6/1999 | Dupre | 239/14.2 |

*Primary Examiner*—Steven O. Douglas
*Attorney, Agent, or Firm*—Carothers & Carophers

[57] ABSTRACT

An economic snow making tower and method of manufacture wherein the snow making tower includes an elongated upright aluminum tower pipe which is mounted on a support. Snow making nozzles are provided at the upper end of the tower for discharge of air and water under pressure into ambient atmosphere for manufacture of snow in subfreezing conditions and air and water connectors are provided at the lower end of the tower pipe for the supply of air and water under pressure to the tower. The support includes a vertical ground support post and a steel T fitting as welded to this support cap and has three threaded connecting necks wherein the upper threaded connecting neck threadably receives the bottom end of the tower pipe and supports the tower pipe in its upright position. The air and water connectors are connected respectively to the two remaining threaded necks of the T fitting. An unthreaded sleeve extension extends coaxially over the lower end of the tower pipe to assist in support thereof from the T fitting. An efficient and effective method is also provided for manufacturing the water and air nozzles provided at the upper end of the tower pipe.

5 Claims, 5 Drawing Sheets

SNOW MAKING TOWER AND METHOD OF MANUFACTURE

This application is a division of application Ser. No. 09/153,975, filed Sep. 16, 1998, and now pending.

BACKGROUND OF THE INVENTION

The present invention relates to snow making equipment, and more particularly to economic snow making towers.

Snow making towers include elongated upright aluminum tower pipes that are mounted on a support and have snow making nozzles at the upper end for discharge of air and water under pressure into ambient atmosphere for manufacture of snow in subfreezing conditions. Air and water connectors are provided at the lower end of the tower for connection to remote sources of air and water under pressure.

The elongated tower pipe is usually supported from the upper end of a vertical ground support post for rotation of the tower in a horizontal plane on the top of the post.

Snow making towers have generally been found to be the most efficient form of manufacturing snow as the air and water under pressure are discharged through nozzles under pressure at a considerable height above the ground thereby providing a lengthy dwell time for the atomized water to crystalize before falling to the ground to thereby form high quality snow particles.

However, a problem encountered with such snow making towers is their excessive weight and expense of manufacture.

In manufacturing snow making tower of the prior art, particularly snow towers of the type which utilize external mixing of the air and water under pressure, it is also extremely difficult to provide or manufacture the respective air and water nozzles so that they are accurately and appropriately aligned with respect to each other to provide desired external intermixing of the air and water in order to provide maximum efficiency and manufacture of quality snow.

It is a principal object of the present invention to minimize these disadvantages of the snow making towers of the prior art.

SUMMARY OF THE INVENTION

The snow making tower of the present invention is extremely light weight and therefore may be more easily and readily handled by ground crews or operators, and they are very simple in construction providing inexpensive manufacture and thereby provide an inexpensive snow making tower for purchase.

As with other snow making towers, the snow making tower of the present invention includes an elongated upright aluminum tower pipe that is mounted on a support post. Air and water connectors are provided at the lower end of the tower pipe for connection to sources of air and water under pressure and snow making nozzles are provided at the upper end of the tower pipe for discharge of air and water under pressure into the surrounding ambient atmosphere for manufacture of snow in subfreezing conditions.

The elongated tower pipe is supported on the top of a vertical ground support post with a steel cap positioned over the upper end of the post for supporting the pipe tower thereon for rotation in a horizontal plane or about the vertical axis of the post so that the tower may be readily rotated and fixed into position for different wind conditions in order to provide proper placement of manufactured snow on the ski slope.

The support for the elongated upright aluminum tower pipe further includes a steel T fitting which is conventionally available on the market. The T fitting is welded to the support cap. This provides a very inexpensive mounting mechanism.

As with all T fittings, this steel T fitting has three threaded connecting necks and the lower end of the tower pipe is threadably received in and supported from the upper threaded neck of the T fitting and the air and water connectors are connected respectively to the two remaining threaded necks of the T fitting.

The upper threaded neck of the T fitting also includes an unthreaded sleeve extension that extends upward coaxially over the lower end of the tower pipe beyond the threads of the lower end of tower pipe that are threadably received in the upper threaded neck of the T fitting. This sleeve is welded to the upper threaded neck of the T fitting and correspondingly assists in supporting the tower pipe from its lower end beyond the threads on its lower end. This added support prevents the elongated aluminum tower pipe from breaking at its weakest point which is at the point the threads at its lower end are normally exposed just beyond its threaded reception into the threaded neck of the T fitting.

This sleeve extension is also preferably provided with a compression coupling at its upper or outer end for engaging the tower pipe with a compression fit to further strengthen the coupling.

The T fitting may be readily welded to the steel swivel cap that is provided on the top of the ground support post by a simple single vertical steel plate thereby making the entire assembly inexpensive and easy to manufacture.

The air and water connectors are preferably positioned immediately adjacent the remaining two threaded lower necks of the T fitting. By thus providing the air and water connectors close to the T fitting, a minimum length of hose will be required for the air and water lines connected respectively to the air and water connectors when the entire tower is rotated in a horizontal plane on the upper end of the ground support post.

The snow making tower of the present invention is readily adapted to either snow making towers wherein the air and water are intermixed internally within the elongated pipe tower or also in pipe towers wherein the air and water under pressure are externally mixed at the upper end of the tower. In this latter situation, an inner air pipe coextends within the tower pipe for independently supplying air under pressure from the air connector to at least one air nozzle adjacent the upper end of the tower pipe.

The tower pipe extends upwardly from the support post at an angle which is less than vertical and the upper portion of the tower pipe containing the snow making nozzles is preferably vertical as provided through a bend in the single pipe or coaxial pipes. This arrangement is preferred because the snow making nozzles may then be positioned so that the thrust of the water and air being ejected under pressure from the nozzles is substantially in line with the underlying major portion of the pipe tower so that no undesired bending moments are applied against the tower pipe which could cause it to bend or break at its lower end. This arrangement also permits the use of lighter weight or thin walled aluminum piping for the tower pipe.

The present invention also provides a unique method of manufacturing the water and air nozzles for such snow making towers having elongated aluminum tower pipes.

In accordance with the teachings of the present invention, water nozzles are manufactured by providing first a preformed solid rib having arcuate contours on a back face of the rib for mating the exterior arcuate contours of the aluminum tower pipe. Both the tower pipe and the rib are manufactured of aluminum.

The rib is positioned on the tower pipe with its back face contours mating the exterior curved contours of the tower pipe. Then the rib is welded to the tower pipe along all exposed adjacent perimeter edges of the rib for thereby providing a water tight seal between the tower pipe and the rib.

Then one or more passages are drilled through the rib and then on through the underlying wall of the tower pipe at the desired angle and the water nozzles are then inserted or installed in these drilled passages. Generally these passages are threaded with a tap and either the nozzles are directly threadably screwed into the passages or an intermediate metal sleeve is first inserted into the passage for follow-up threadable reception of the nozzle.

Using this method, multiple passages may be drilled at accurate predetermined angles through the rib and the underlying wall at the tower pipe to provide extremely accurate positioning of the spaced water nozzles and to further provide a very inexpensive method for manufacturing and attaching nozzle connections to the tower pipe.

This method is particularly useful for pipe towers that utilize external mixing of air and water under pressure and the present invention further includes the unique method for also manufacturing the corresponding air nozzles for accurate alignment with the water nozzle discharges.

With this method, the elongated aluminum pipe tower is provided with an internal coextending smaller air pipe. The method of the present invention includes the steps of first notching the upper end wall of the tower pipe and also notching the upper end of the corresponding air pipe and radially aligning the notches between the internal air pipe and the external tower pipe.

A metal plug of corresponding fit for the aligned notches is fit into the notches and bridges the notches from the internal air pipe to the external water pipe or elongated tower pipe. The plug is then welded to the pipe end walls about the perimeters of the notches for thereby providing a water tight seal. Thereafter end covers are respectively welded over the notched end of the air pipe and then over the notched end of the water pipe for providing respective water tight end seals on the pipes. The plugs are thereafter accurately drilled at the proper angle for drilling a passage through the plug for thereby providing an air nozzle passage from the interior of the air pipe to the exterior of the tower pipe.

It can be readily envisioned that this method permits extremely accurate alignment of the air nozzles with the corresponding water nozzles in order to provide the desired external mixing characteristics.

Any number of air nozzles may be provided in the upper end of the pipe tower by this method by providing multiple such aligned notches on adjacent radii n the pipe end walls and respectively bridging the aligned notches with plugs, welding them into position and then drilling each one of the plugs either before or after the end caps are respectively welded over the upper ends of the pipes.

The support post for the snow making tower structure may be provided in simple form as a wooden post that is provided with X cross brackets at its base and set into a hole in the ground surface. The hole is simply filled with dry mortar or cement mix and covered over. In a matter of days the cement mixture will draw moisture from the surrounding soil and become hard and cured to securely hold the post in position to thereby provide an inexpensive method of supporting the snow making tower.

BRIEF DESCRIPTION OF THE DRAWINGS

Other objects and advantages appear hereinafter in the following description and claims. The drawings show, for the purpose of exemplification, without limiting the scope of the invention or appended claims, certain practical embodiments of the present invention wherein:

DETAILED DESCRIPTION OF A PREFERRED EMBODIMENT

Figure 1:
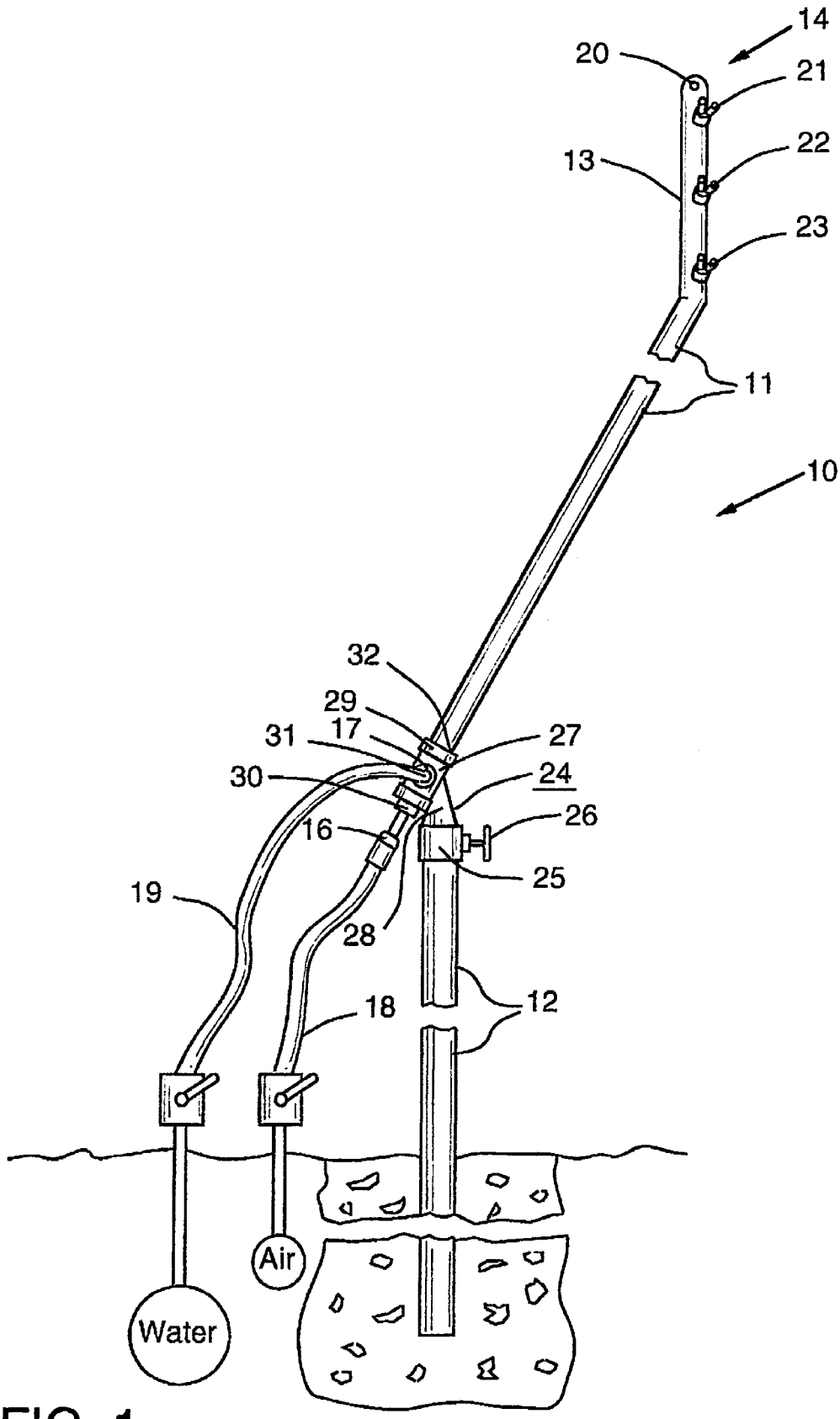
FIG. 1 is a schematic view in vertical side elevation illustrating the snow making tower of the present invention and its method of manufacture.

Referring to the drawings, the snow making tower 10 of the present invention includes an elongated upright aluminum tower pipe 11 which is supported above ground from ground support pole 12 so that the lower end of the tower pipe 11 is supported at 60° relative to horizontal and the upper end portion 13 of the tower pipe, which contains nozzles 14, extends vertically from bend 15 in tower pipe 11.

Air and water connectors 16 and 17 respectively are provided at the lower end of pipe tower 11 for connection to sources of air and water under pressure through hoses 18 and 19.

Snow making nozzles 14 at the upper end of elongated tower pipe 11 are provided in the form of three air nozzles 20 and three vertically spaced sets of three water nozzles 21, 22 and 23 respectively.

Air is discharged under pressure through air nozzles 20 into the throat of water discharge sprays from water nozzles 21 respectively to further atomize the water sprays to provide quality snow in subfreezing ambient conditions as is taught in previous Dupre patents pertaining to snow making towers.

Tower pipe 11 is supported on support post 12 by support 24 which includes a steel cap 25 for rotation of tower pipe 11 on the top of support post 12 in a horizontal plane about the vertical axis of post 12.

A locking screw 26 is provided with a handle for locking the cap 25 in position after the desired position of rotation has been attained.

Support 24 further includes a conventional steel T fitting 27 that is welded to support cap 25 via a single vertical steel support plate 28.

T fitting 27 is provided with three threaded connecting necks in conventional fashion. This includes upper threaded neck 29 and lower threaded T connection necks 30 and 31 for respective connection to air and water connectors 16 and 17.

The lower end of tower pipe 11 is threadably received in and supported from the upper threaded neck 29 of T fitting 27.

Figure 2:
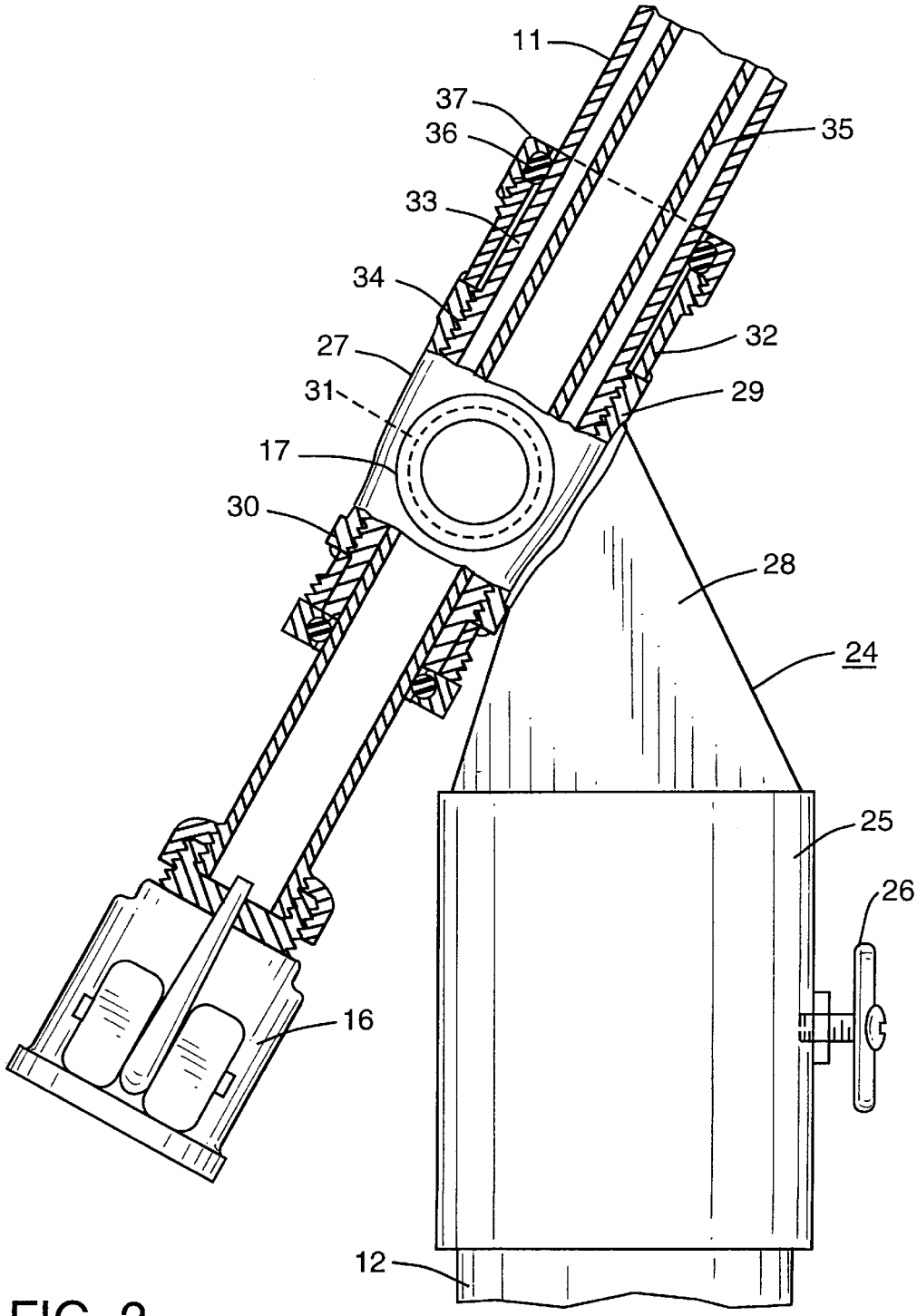
FIG. 2 is an enlarged view showing the lower supporting end of the snow making tower of FIG. 1 with portions thereof illustrated in vertical mid cross section.

As is best seen in FIG. 2, the upper threaded neck 29 of T fitting 27 includes an unthreaded sleeve extension 32 which is welded to the upper threaded neck 29 and extends upward coaxially over the lower end 33 of tower pipe 11 and beyond any threads 34 on the lower end 33 thereby supporting the tower pipe 11 from its lower end beyond the threads 34. This threaded portion 34 is the weakest point of support for the tower pipe 11 where it is exposed upwardly from T fitting 27, and the sleeve 32 further supports the lower end 33 of tower pipe 11 to prevent the aluminum pipe from breaking at the point where the threads 34 immediately exit the upper threaded neck 29 of T fitting 27.

Sleeve 32 is further provided at its upper end with a compression coupling in the form of threaded ring cap 37 and O-ring 36 for engaging the tower pipe 11 with a compression fit as illustrated in FIG. 2. This further strengthens the coupling and permits one to suspend more tower pipe 11 from the coupling than would otherwise be possible.

Inner air conduit or pipe 35 coextends within tower pipe 11 for independently supplying air under pressure from air connector 16 to the three air nozzles 20 adjacent the upper end of tower pipe 11.

As previously indicated, the upper portion 13 of tower pipe 11 is bent to vertical through bend 15 and the air nozzles eject horizontally into the throat of the water discharged from the three water nozzles 21. All the water nozzles are positioned at an angle of approximately 45° from vertical so that the major thrust from all nozzles is directed such that the vector forces therefrom are directed downwardly substantially in line with or through the base portion of tower pipe 11 and accordingly no major bending moments are applied to the upper end of the tower pipe 11 by reason of the thrust from the discharges from the air and water nozzles.

The snow making tower of the present invention is extremely light weight and may therefore be easily replaced on support post 12 with snow making towers 10 of the same type having different nozzle orifice configurations for different ambient temperature conditions.

In addition, the snow tower 11 is inexpensive and easy to manufacture. In this regard, the method of the present invention provides a novel method for manufacturing the air and water nozzles for the tower 10 of the present invention. This is best illustrated in conjunction with FIGS. 3 through 6.

Figure 6:
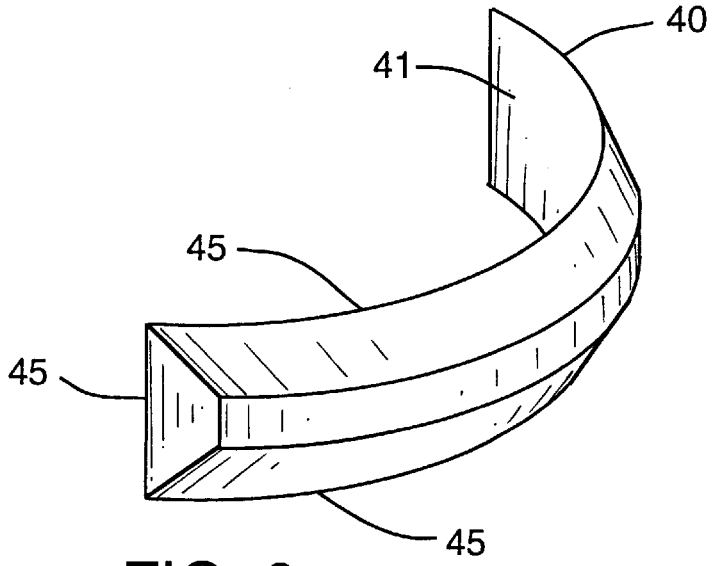
FIG. 6 is a perspective view of the metal rib for the water nozzles as shown in FIGS. 3, 4 and 5 prior to drilling of passages therethrough for insertion or installation of water nozzles.

The water nozzles for the snow making tower 10 of the present invention are manufactured by first providing a solid preformed aluminum rib 40, as independently seen in FIG. 6, having arcuate contours 41 on the back face thereof for mating exterior arcuate contours 42 of tower pipe 11.

Figure 3:
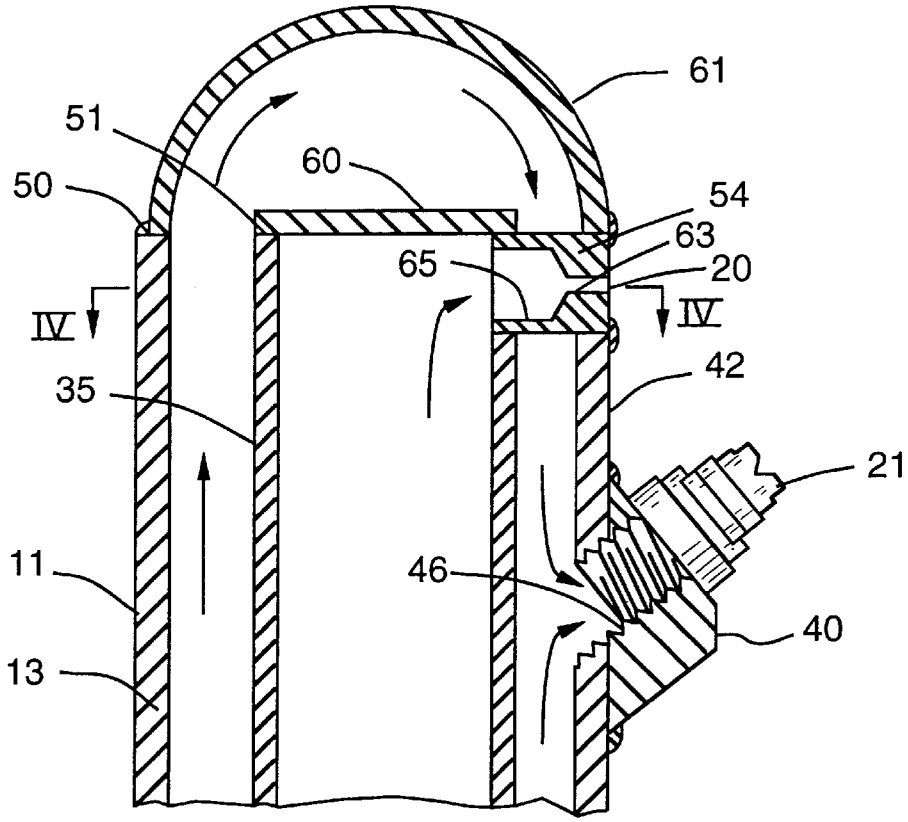
FIG. 3 is an enlarged view in vertical mid cross section showing the upper end of the pipe snow making tower of FIG. 1.
Figure 4:
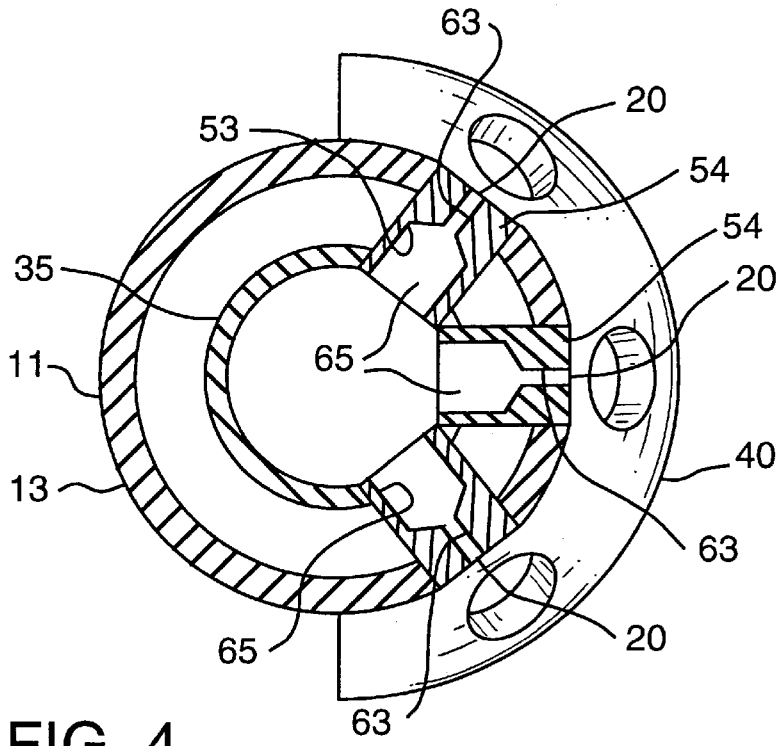
FIG. 4 is a view in horizontal cross section of the upper end of the snow making tower shown in FIGS. 1 and 3 without the water nozzles and as seen along section line IV—IV of FIG.3.

Rib 40 is positioned on the upper end 13 of tower pipe 11 as illustrated in FIG. 3, with the back face contours 41 thereof mating the exterior contours 42 of tower pipe 11.

Then the rib 40 is welded to tower pipe 11 along all exposed adjacent perimeter edges 45 for thereby providing a water tight seal between tower pipe 11 and rib 40. When this has been accomplished, passages 46 are drilled at a predetermined angle through rib 40 and on through the underlying wall of tower pipe 11 as illustrated. These drilled passages are then threaded and water nozzles 21, 22 and 23 are threadably installed. Accordingly, very accurate positioning and alignment and installation of the water nozzles is provided.

The air nozzles 20 of the snow making tower 10 of the present invention are also uniquely manufactured by notching the upper end wall 50 of tower pipe 11 and correspondingly notching the upper end wall 51 of internal air pipe 35 thereby providing radially aligned notches 52 and 53 respectively in pipe end 50 and pipe end 51.

Figure 5:
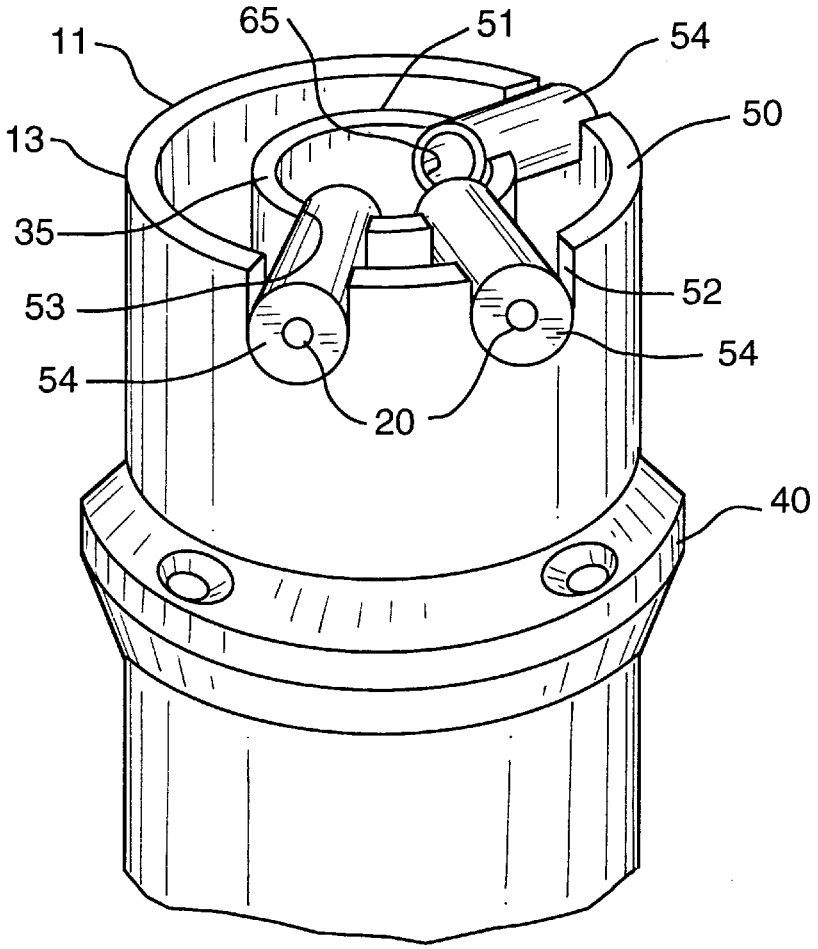
FIG. 5 is a perspective view as seen from the right side of the upper end of the tower of FIG. 3 with the upper end covers uninstalled or removed for internal viewing.

Solid plugs 54 corresponding to notches 52 and 53 are inserted into these notches for bridging notches 52 and 53 as illustrated in the figures. The solid plugs are then welded to pipe end walls 50 and 51 respectively about the perimeter of notches 52 and 53 for thereby providing a water tight seal therebetween. This is best illustrated in FIG. 5.

As is best illustrated in FIG.3, end covers 60 and 61 are then respectively welded over notched ends 51 and 50 of air pipe 35 and water pipe 11 for providing respective water tight end seals on the pipes.

Once this has been accomplished then the respective plugs 54 are drilled to provide respective air passages 63 therethrough thereby providing air nozzle passages 20 from the interior of air pipe 35 to the exterior of tower pipe 11. Here again, this method of the present invention provides great ease of manufacture for the air nozzles and further provides a method for accurately aligning the air discharges for these respective nozzles.

The snow making tower 10 of the present invention is thus not only extremely easy to manufacture, but it has an extremely overall light weight for ease of handling. No support arm is required as is normally the situation for supporting the pipe tower 11 on the upper end of support post 12.

In addition, all parts are inexpensive and readily found available on the market.

The hose connections 16 and 17 for hoses 18 and 19 are provided very close to the pivot point of cap 25 and accordingly, very short lengths of hose may be utilized for the snow making tower 10 even thought it pivots about the upper end of support post 12 in view of the fact that connections 16 and 17 are very close to the point of rotation and do not extend to an undue length below this point of pivot.

Because each of the towers 10 are extremely light weight and may be replaced in their entireties with ease, the base support 24 for the towers may each be painted a different color for different nozzle configurations inserted in respective towers. Accordingly, the entire tower may be changed out in order to readily change nozzle configurations for different ambient temperature conditions.

The plugs 54 need not necessarily be solid throughout and may be initially provided with hollow contours 65 so that the drilled passages 63 do not have to be drilled for the entire length of the plugs 54.

Figure 7:
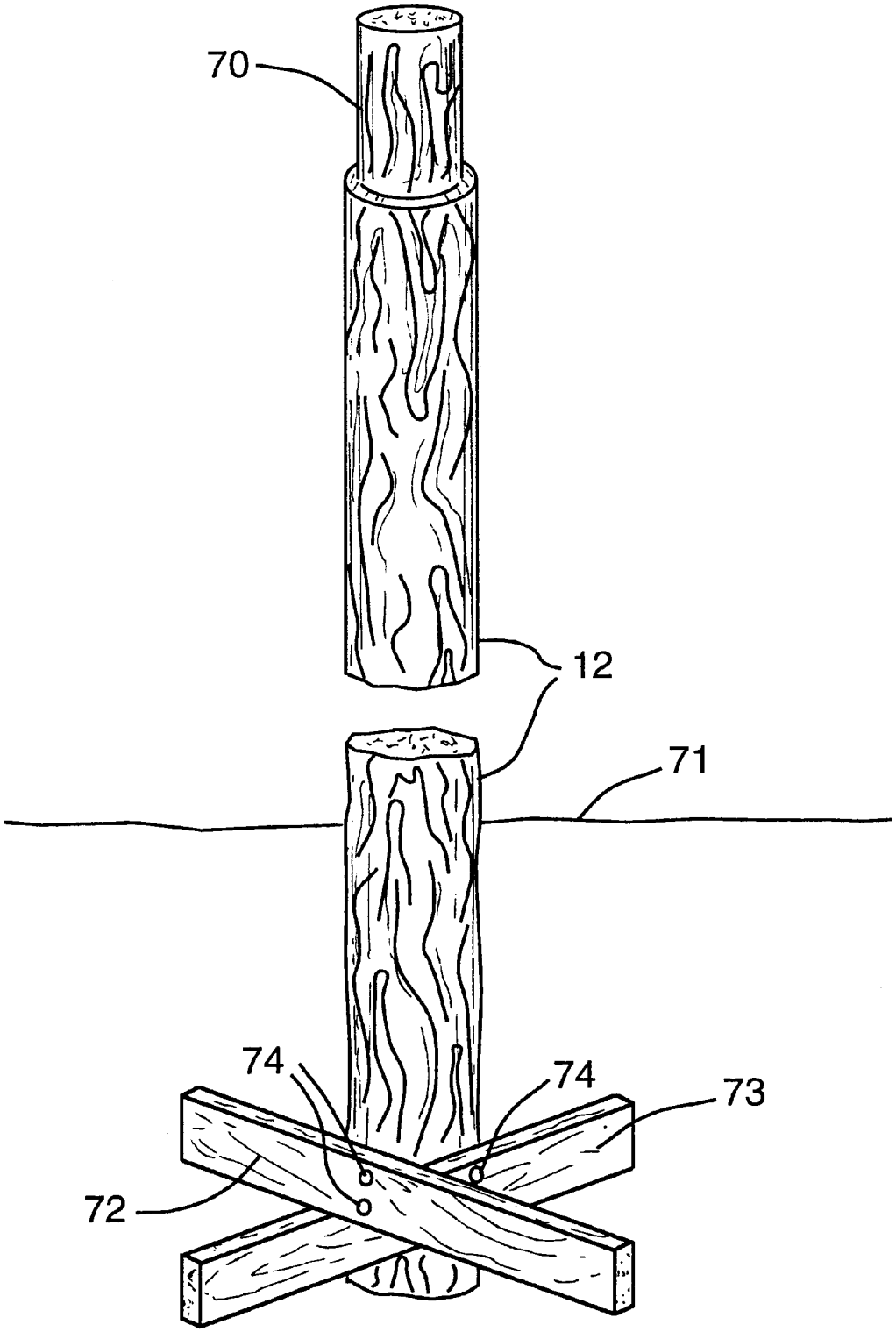
FIG. 7 is a perspective view in side elevation illustrating an alternative simple wooden post mount for the snow making tower structure of FIG. 1.

Turning next to FIG. 7. An alternate form of support post 12 is illustrated in the form of a common wood post which has been roughly shaped with a chain saw. The upper end of post 12 is further necked down or shaped as indicated at 70 to provide a neck on which to receive pipe cap 25 for pivotal movement.

The bottom end of support post 12 is provided with X cross bracing in the form of two board scraps 72 and 73 which are secured at 74 to the post 12 by conventional nails or lag screws.

The entire lower end is then buried into the ground surface 71 and covered with a dry mortar or cement mix and then covered over with earth.

In a matter of days, the cement will draw sufficient moisture from the surrounding soil to harden and cure the cement mixture and securely anchor the bottom end of post 12 into the ground surface 71, thereby providing an extremely inexpensive way for providing a support for the tower structure shown in FIG. 1.

I claim:

1. A method of manufacturing water nozzles for a snow making tower having an elongated aluminum tower pipe for conveying water, comprising the steps of: providing a preformed solid rib having arcuate contours on a back face thereof for mating exterior arcuate contours of said tower pipe; positioning said rib on said tower pipe with said back face contours of said rib mating said exterior contours of said tower pipe; welding said rib to said tower pipe along all exposed adjacent perimeter edges of said rib for thereby providing a water tight seal between said tower pipe and said rib; drilling a passage at a predetermined angle through said rib and on through an underlying wall of said tower pipe; and installing water nozzles in said passages.

2. The method of claim 1 wherein the steps of drilling and installing include the steps of drilling multiple passages at predetermined angles through said rib and underlying wall of said tower pipe and respectively inserting water nozzles in said passages.

3. The method of claim 1 further including the method of manufacturing air nozzles for said snow making tower which includes an internal coextending air pipe, comprising the steps of: notching one end wall of said tower pipe and notching a corresponding end wall of said internal air pipe and radially aligning said notches; inserting a plug of corresponding fit into said notches for thereby bridging said notches; welding said plug to said pipe end walls about the perimeter of said notches for thereby providing a water tight seal therebetween; welding end covers respectively over said notched ends of said air pipe and water pipe for providing respective water tight end seals on said pipes; and drilling a passage through said plug for thereby providing an air nozzle passage from the interior of said air pipe to the exterior of said tower pipe.

4. A method of manufacturing air nozzles for a snow making tower having an elongated aluminum tower pipe for conveying water and an internal coextending air pipe for conveying air, comprising the steps of: notching one end wall of said tower pipe and notching a corresponding end wall of said internal air pipe and radially aligning said notches; inserting a plug of corresponding fit into said notches for thereby bridging said notches; welding said plug to said pipe end walls about the perimeter of said notches for thereby providing a water tight seal therebetween; welding end covers respectively over said notched ends of said air pipe and water pipe for providing respective water tight end seals on said pipes; and drilling a passage through said plug for thereby providing an air nozzle passage from the interior of said air pipe to the exterior of said tower pipe.

5. The method of claim 4, wherein the steps of notching, bridging and welding further include the steps of providing multiple such aligned notches in said pipe end walls, respectively bridging said aligned notches with plugs and respectively welding said plugs to the perimeters of said notches for providing water tight seals therebetween prior to the step welding end covers on said pipe ends, and respectively drilling passages through said plugs for thereby providing multiple spaced air nozzles.

* * * * *